US007091439B2

(12) United States Patent
Vaghini et al.

(10) Patent No.: US 7,091,439 B2
(45) Date of Patent: Aug. 15, 2006

(54) ISOLATOR/CIRCUIT-BREAKER DEVICE FOR ELECTRIC SUBSTATIONS

(75) Inventors: Alberto Vaghini, Piacenza (IT); Giorgio Perli, Bergamo (IT); Armando Rossi, Alatri (IT)

(73) Assignee: Vei Power Distribution, S.p.A., Milan (IT)

( * ) Notice: Subject to any disclaimer, the term of this patent is extended or adjusted under 35 U.S.C. 154(b) by 0 days.

(21) Appl. No.: 11/000,513

(22) Filed: Dec. 1, 2004

(65) Prior Publication Data

US 2005/0150869 A1 Jul. 14, 2005

(30) Foreign Application Priority Data

Dec. 2, 2003 (IT) ..... MI2003A2355
Dec. 2, 2003 (IT) ..... MI2003A2356
Dec. 2, 2003 (IT) ..... MI2003A2357
Dec. 2, 2003 (IT) ..... MI2003A2358
Dec. 2, 2003 (IT) ..... MI2003A2359

(51) Int. Cl.
*H01H 9/40* (2006.01)

(52) U.S. Cl. ..... 218/154; 218/7

(58) Field of Classification Search ..... 218/3, 218/7, 14, 78–80, 84, 153, 154, 140, 120
See application file for complete search history.

(56) References Cited

U.S. PATENT DOCUMENTS 3,259,726 A 7/1966 Rueffer
3,814,883 A 6/1974 Milianowicz
4,105,878 A * 8/1978 Date et al. ..... 218/14
4,147,999 A * 4/1979 Eley ..... 335/35
4,225,763 A 9/1980 Barkan
4,713,503 A 12/1987 Kamp
6,362,444 B1 3/2002 Lee
6,437,276 B1 * 8/2002 Bruchmann et al. ..... 218/153
6,649,853 B1 * 11/2003 Takagi et al. ..... 218/7
6,683,267 B1 * 1/2004 Piazza et al. ..... 218/7

(Continued)

FOREIGN PATENT DOCUMENTS

BE 788 180 2/1973

(Continued)

OTHER PUBLICATIONS

U.S. Appl. No. 11/204,368, filed Aug. 16, 2005, entitled "Switch and Disconnector Apparatus for Electric Substations".

*Primary Examiner*—Lincoln Donovan
*Assistant Examiner*—M. Fishman
(74) *Attorney, Agent, or Firm*—Nixon & Vanderhye, P.C.

(57) ABSTRACT

An electric device, in particular for medium or high voltage electric substations, able to perform the functions of circuit-breaking, isolating and earthing is described. The device comprises: a casing; at least one circuit-breaker; at least one line isolator having a fixed isolator contact; a line isolator actuating shaft for actuating the at least one line isolator; at least one earthing isolator; a circuit-breaker actuating shaft for actuating at least one circuit-breaker; and a lever connected to a conductor rod co-operating with movable circuit-breaker contacts, said conductor rod further engaging with said fixed isolator contact in a closing position, wherein: the device further comprises a resilient member co-operating with said conductor rod in order to transfer correct pressing loads to said movable contacts. According to the invention, said circuit-breaker actuating shaft and said line isolator actuating shaft are coaxial. Profitably, the casing is filled with nitrogen or sulphur hexafluoride.

32 Claims, 10 Drawing Sheets

U.S. PATENT DOCUMENTS 6,723,939 B1 * 4/2004 Hoglund et al. ..... 218/78

FOREIGN PATENT DOCUMENTS

| | | |
|---|---|---|
| DE | 957 410 | 1/1957 |
| DE | 1 244 913 B | 7/1967 |
| DE | 73 16 028 | 10/1974 |
| EP | 0 737 993 A1 | 10/1996 |
| EP | 1 226 596 A0 | 7/2002 |
| FR | 870 991 | 4/1942 |
| FR | 2 839 193 A | 10/2003 |

* cited by examiner

ISOLATOR/CIRCUIT-BREAKER DEVICE FOR ELECTRIC SUBSTATIONS

This application is based on, and claims the benefit of, Italian Patent Applications Nos. MI2003A002355, MI2003A002356, MI2003A002357, MI2003A002358, MI2003A002359 all filed on Dec. 2, 2003, which are all incorporated by reference herein.

BACKGROUND

1. Field of the Invention

The present invention relates to an electric device, in particular for medium or high voltage electric substations, able to perform the functions of circuit-breaking, isolating and earthing. In other words, the invention relates to a device suitable for installation in cubicles of the protected type which form medium or high voltage electric switchboards. According to one embodiment, the device of the invention has a resilient member for transferring correct pressing loads to the circuit-breakers. Furthermore, in the device according to one embodiment of the invention, a circuit-breaker actuating shaft and a line isolator actuating shaft are coaxial.

2. Related Art and Other Considerations

As is known, an electric substation receives voltage from voltage busbars and conveys current via a line directed to the user. Electric devices, typically (line and earthing) circuit-breaker and isolators, are provided between the voltage busbars and the line directed to the user.

A circuit-breaker for electric substations is able to protect the line directed to the user. A line isolator, after the circuit-breaker has opened the line directed to the user from the voltage supply busbars, is able to disconnect the line physically. Finally, an earthing isolator, again after the line isolator has disconnected the line directed to the user from the voltage supply busbars, earths the line directed to the user in order to avoid the occurrence of discharges or induced currents. The assembly formed by all the above-mentioned devices, as well as other devices not relevant for the purposes of the present invention, which are present in an electric energy distribution node, is generally referred to by the term "switchboard". Each switchboard is composed of several cubicles in each of which the circuit-breaking, isolating and earthing functions for each line are contained.

At present, in most of the cubicles which are commercially available, the same functions are performed using different apparatus for isolation, earthing and circuit-breaking. In particular, the circuit-breaker is usually a separate component.

The known cubicles generally have fairly large dimensions. Typically they have a height of between about 170 and 250 cm, a depth of about 100 cm and a width of between about 50 and 100 cm.

EP 1,226,596 in the name of the same Applicant describes a three-pole apparatus for electric substations, having an extremely compact structure compared to the known apparatus. The device according to EP 1,226,596 comprises a series of isolating devices which comprise at least one line isolator, a circuit-breaker and an earthing isolator. The circuit-breaker is sealed inside a vessel in a vacuum and is positioned in series with a line/earth isolator device which is movable between a first position where it connects said circuit-breaker to a contact of the voltage busbars and a second position where it connects the circuit-breaker to an earthing contact. According to EP 1,226,596, the line/earth isolator and the circuit-breaker are all contained in a metal casing and the metal insulators are arranged at the input and output terminals of the device.

The device according to EP 1,226,596 represented a notable improvement compared to the known devices, in particular because of its extremely small dimensions.

In the device according to EP 1,226,596, a single shaft (denoted by the reference number 10) actuates the circuit-breakers by means of a lever connected thereto. Moreover, another shaft (indicated by the reference number 9) actuates the line isolators by means of another lever connected thereto. The line isolator shaft is situated at a distance from the circuit-breaker shaft and this complicates the arrangement of the various mechanisms inside the casing of the device and prevents optimum use of the available space, which is restricted by the small dimensions of the device.

As is known, the movable contacts in a vacuum circuit-breaker for use in medium or high voltage substations must be moved with a high degree of precision and in a substantially instantaneous manner, i.e. within the space of a few milliseconds.

Another problem associated with the operation of vacuum circuit-breakers consists in the extremely high pressing loads. Typically these loads are in the region of 1000–1500 N or more. As mentioned above, in the device according to the patent EP 1,226,596, these loads are transferred by means of the lever connected to the shaft 10. In particular, the lever connected to the shaft 10 actuates a round conductor rod with which it is pivotally hinged and a small cylinder which comes into contact with the movable circuit-breaker contacts. The Applicant has ascertained that such an essentially rigid configuration is unable to transfer (and maintain) in a sufficiently reliable and precise manner the abovementioned pressing loads onto the movable circuit-breaker contacts. Furthermore, the Applicant has faced the problem to optimize the space inside the device and to provide an optimized arrangement within the device.

U.S. Pat. No. 6,362,444 discloses a gas insulating switchgear which is not adapted for use in modular cubicles of medium voltage switchboards. The switchgear according to U.S. Pat. No. 6,362,444 can not be connected to voltage supply busbars.

U.S. Pat. No. 4,225,763 describes means for suppressing contact-separation at the end of a vacuum circuit breaker closing operation. The vacuum circuit breaker according to U.S. Pat. No. 4,225,763 does not perform any line isolator and earthing isolator function.

DE 12 44 913 describes a pure vacuum switch for high voltage substations which does not perform any line isolator and earthing isolator function.

EP 0,737,993 describes an hybrid break device for high tension which does not perform any line isolator and earthing isolator function.

FR 2,839,193 describes a hybrid switching mechanism with a dielectric filled gas envelope (12) and a vacuum switch envelope. The mechanism does not perform any line isolator and earthing isolator function.

U.S. Pat. No. 4,713,503 describes a three-phase vacuum switch operating mechanism with anti-bounce device for interrupter contacts.

BRIEF SUMMARY

In an electric device, for example of the three-phase type, the pressing loads on the movable circuit-breaker contacts are transferred in a precise and reliable manner.

According to a first aspect of the present technology, an electric device is provided, said device comprises: a casing;

at least one circuit-breaker; at least one line isolator having a fixed isolator contact; a line isolator actuating shaft for actuating the at least one line isolator; at least one earthing isolator; a circuit-breaker actuating shaft for actuating at least one circuit-breaker; and a lever connected to a conductor rod co-operating with movable circuit-breaker contacts, said conductor rod further engaging with said fixed isolator contact in a closing position. The device further comprises a resilient member co-operating with said conductor rod in order to transfer correct pressing loads to said movable contacts. According to the first aspect, said circuit-breaker actuating shaft and said line isolator actuating shaft are coaxial.

Profitably, said resilient member is in the form of a compression spring.

Preferably, said resilient member is housed inside a cavity in said conductor rod.

According to a preferred embodiment, for each circuit-breaker, a cup member connected to said movable circuit-breaker contacts is provided.

In a preferred embodiment, said lever is connected to the conductor rod by means of a pin and said cup member comprises a longitudinally extending eyelet.

Profitably, said resilient member co-operates with a spacer.

Preferably, there are sliding contacts between the cup member and the conductor rod.

Profitably, there are centring guides between cup member and round conductor rod.

The electric device according to the technology also comprises a mechanism for applying a rotational torque onto said circuit-breaker actuating shaft in at least one intermediate position along its length, said mechanism comprising a first shaft accessible from the outside of said casing and a lever mechanism connecting said first shaft to said circuit-breaker actuating shalt.

Profitably, for each circuit-breaker, a pair of levers made of electrically insulating material are provided, said levers being keyed to said circuit-breaker actuating shaft.

Typically, the insulating material is a material chosen from the group consisting of: polycarbonate, nylon, polyester, BMC, SMC, polyamides or the like.

Profitably, the circuit-breaker actuating shaft has a cross-section which is polygonal.

According to a preferred embodiment, the electric device of the technology is composed of two or more phases and comprises at least two circuit-breakers, at least two corresponding line isolators and at least two corresponding earthing isolators, in which a segregation baffle is provided between each line isolator and the corresponding earthing isolator in order to segregate one phase of the device from the adjacent phase.

According to a more preferred embodiment, the device is a three-phase device.

Profitably, each circuit-breaker is axially aligned with a respective line isolator.

Preferably, each circuit-breaker comprises a bulb housed inside a respective insulating body projecting from the casing.

Preferably, said casing is at least partially filled with a gas that is substantially inert in use. The gas is preferably selected from the group comprising: nitrogen, sulphur hexafluoride and any mixture thereof.

According to a further aspect, the present technology provides an electric device comprising: a casing; at least one circuit-breaker having movable circuit-breaker contacts; at least one line isolator having a fixed isolator contact; at least one earthing isolator, a circuit-breaker actuating shaft for actuating at least one circuit-breaker; and a lever connected to a conductor rod co-operating with movable circuit-breaker contacts, said conductor rod further engaging with said fixed isolator contact in a closing position, wherein it further comprises a mechanism for applying a rotational torque onto said circuit-breaker actuating shaft in at least one intermediate position along its length.

The mechanism for applying a rotational torque onto said circuit-breaker actuating shaft in at least one intermediate position along its length overcomes the problems of the deformation of the circuit-breaker actuating shaft and of the casing, thus resulting in a more reliable electric device.

According to a different aspect, the present technology provides an electric device comprising: a casing; at least one circuit-breaker having movable circuit-breaker contacts; at least one line isolator having a fixed isolator contact; at least one earthing isolator; a circuit-breaker actuating shaft for actuating at least one circuit-breaker; and a lever connected to a conductor rod co-operating with movable circuit-breaker contacts, wherein, each circuit-breaker is associated with a pair of said levers and wherein said levers are made of an electrically insulating material. This embodiment solves the problem of providing an electric device wherein the one or more circuit-breakers are electrically insulated from the circuit-breaker actuating shaft. The levers are robust and provide a reliable operation of the circuit-breakers.

According to a further aspect, the present technology provides an electric device having two or more phases, said device comprising: a casing; at least two circuit-breakers, at least two corresponding line isolators and at least two corresponding earthing isolators, wherein a segregation baffle is provided between a line isolator and a corresponding earthing isolator of a first phase and a line isolator and a corresponding earthing isolator of an adjacent second phase in order to segregate said first phase of the device from the adjacent second phase. This arrangement is advantageous as it intercepts any discharges between two adjacent phases.

According to a different aspect, the present technology provides a cubicle for a switchboard comprising at least one electric device as set above.

According to a further aspect, the present technology provides a switchboard comprising one or more cubicles as set above.

The present invention will become fully clear from the detailed description which follows, provided by way of a non-limiting example, to be read with reference to the accompanying illustrative sheets of drawings.

DETAILED DESCRIPTION

Figure 1:
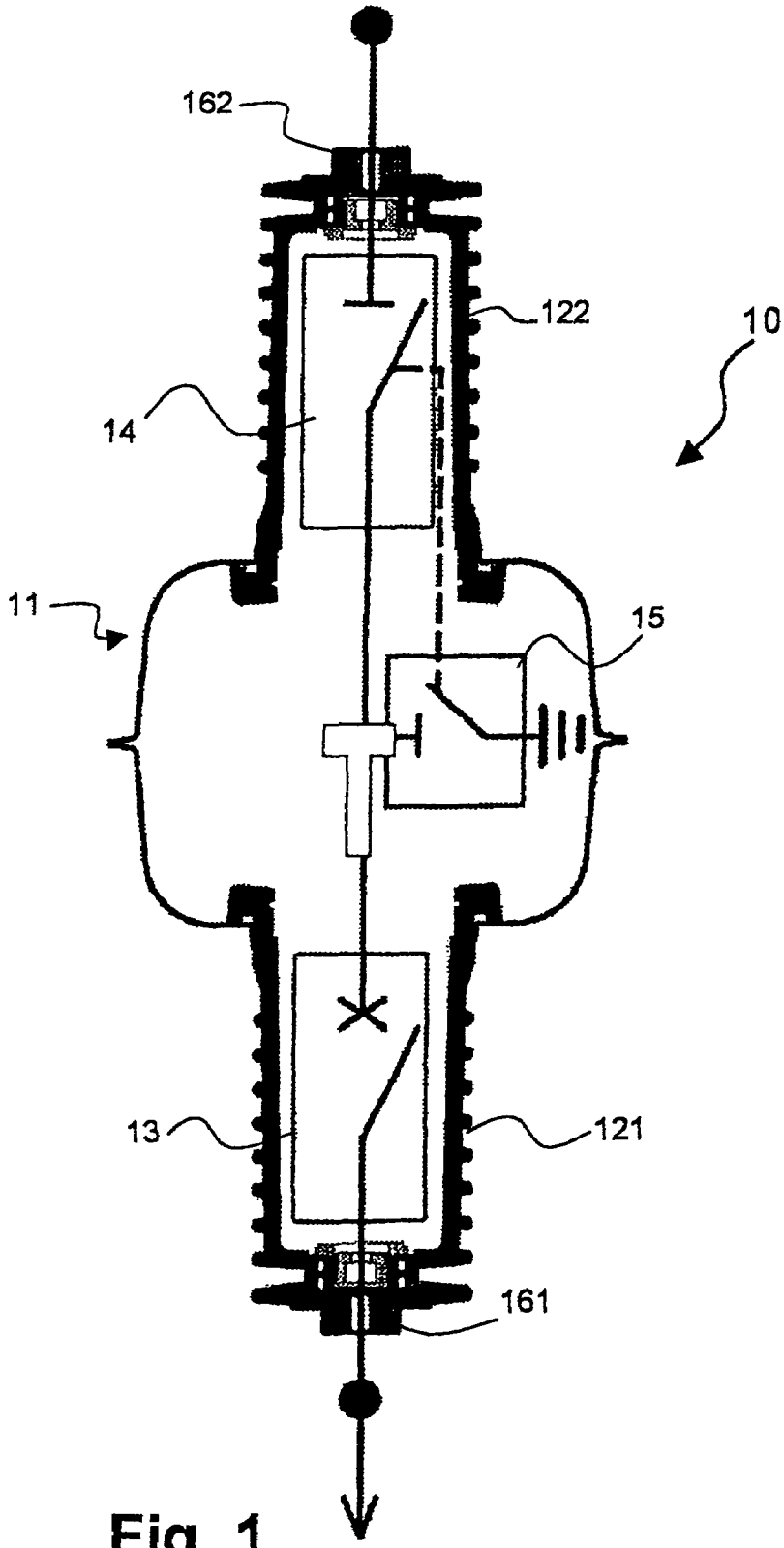
FIG. 1 shows schematically the device according to an example embodiment.

FIG. 1 shows schematically a three-phase device 10 according to the present invention. Obviously, the device 10 could also be two-phase or single-phase instead of three-phase. A three-phase device is described solely by way of a non-limiting example. The three-phase device 10 according to the present invention comprises a first shell 111 and a second shell 112 which can be joined together and sealingly welded along respective contact edges so as to form, overall, a casing 11. Preferably, the casing 11 is made of steel and the empty spaces inside it are filled with gas, typically sulphur hexafluoride ($SF_6$), nitrogen, a mixture thereof or any other inert gas. Nitrogen is deemed the best for containing environment pollution.

Figure 2:
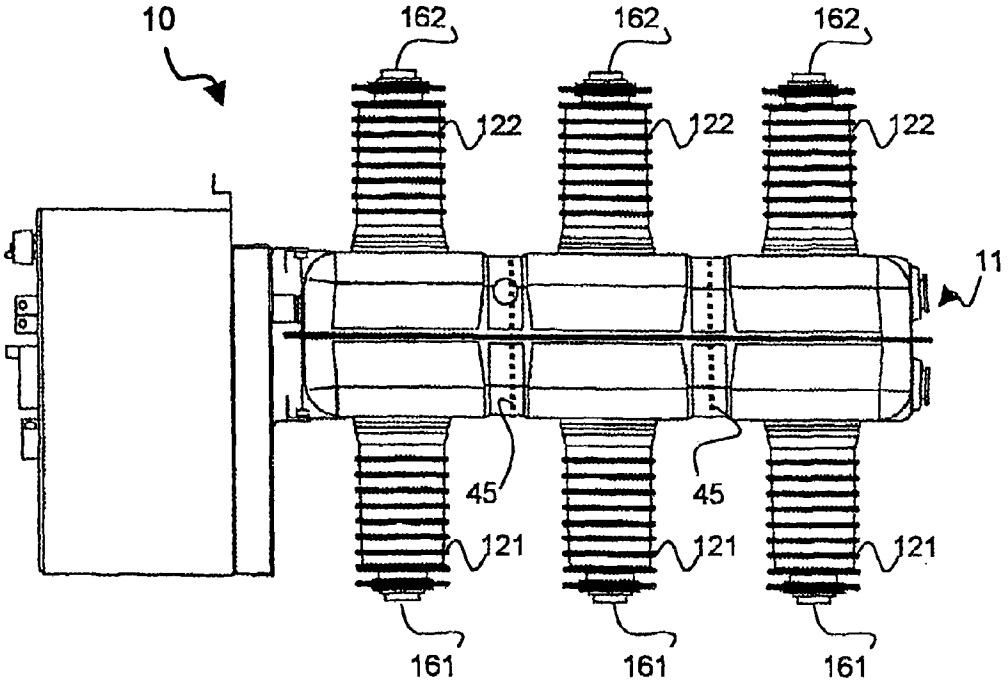
FIG. 2 shows schematically a side view of the device according to an example embodiment and the assembly which actuates the circuit-breaker and isolator devices.

Three insulating bodies 121, 122 (one for each phase of the three-phase device) extend from the first and second shells 111, 112, resulting in a total of six substantially mutually facing insulating bodies (FIG. 2). Typically, the insulating bodies are made of epoxy resin or a similar material. The insulating bodies 121 of one shell 111 (the bottom shell in FIGS. 1 and 2) house respective sealed bulbs or vessels 131 of vacuum circuit-breakers 13. Each circuit-breaker 13 comprises movable contacts 132 and fixed contacts 133. Therefore, each bulb is seated inside the bottom through-hole insulating body. In a preferred embodiment, the bulb acts as a counter-mould and the associated insulating body is cast directly around it. This proves to be advantageous in terms of the dielectric properties and mechanical strength.

The insulating bodies 122 of the other shell 112 (top shell in FIGS. 1 and 2) house respective line isolators 14. Earthing isolators 15 and the various mechanisms for actuating the circuit-breakers 13 and the isolators 14, 15 are housed inside the casing 11.

An end-piece 161, 162 projects from each insulating body 121, 122; for the sake of convenience of the description they will be called "bottom end-piece" 161 and "top end-piece" 162 with reference to the configurations shown in the various figures. Each bottom end-piece 161 is in electrical contact with the fixed contacts 133 of the respective circuit-breaker 13, while each top end-piece 162 is in contact with a fixed isolator contact 141.

Figure 3:
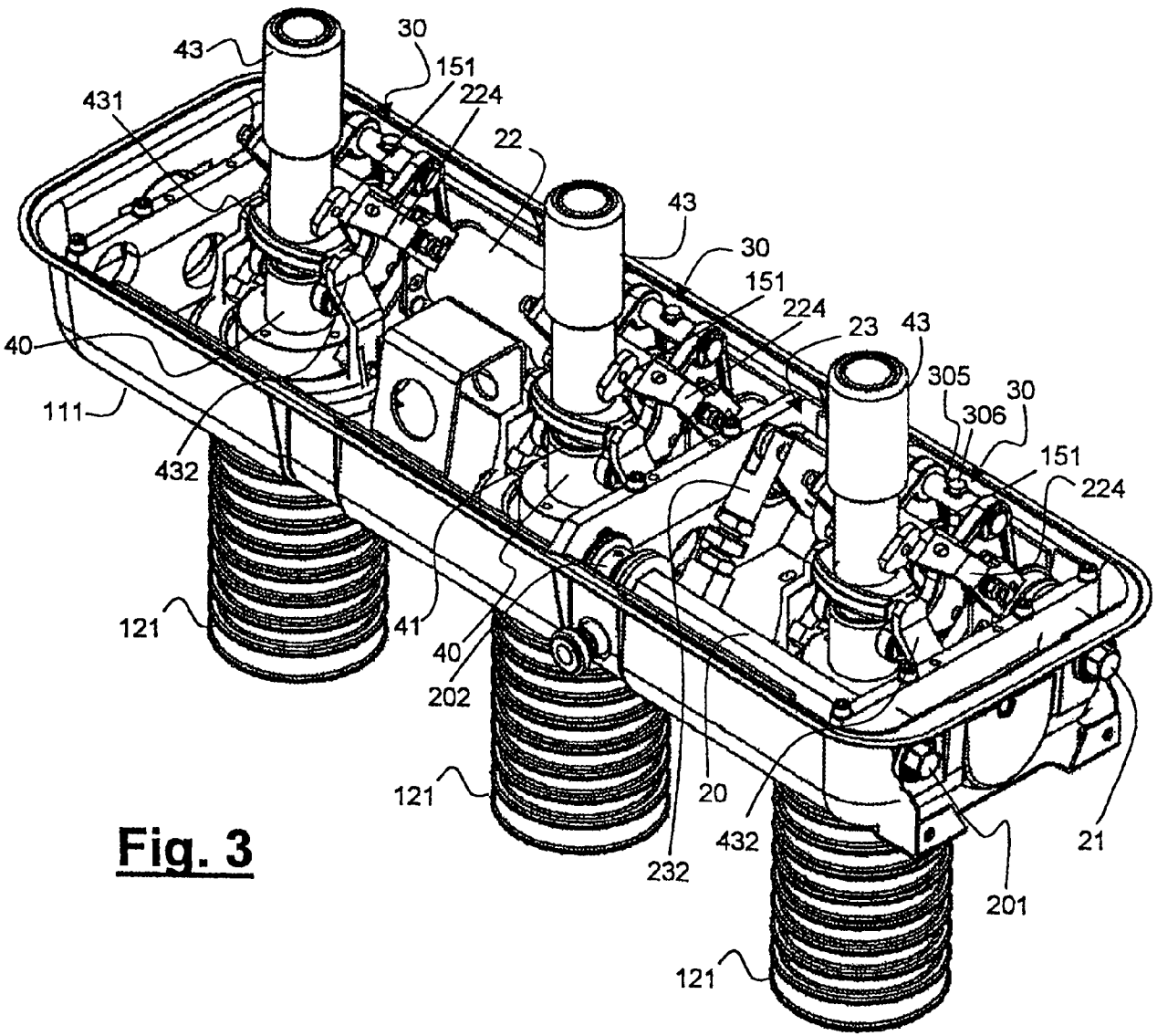
FIG. 3 is an axonometric view of the inside of the device according to an example embodiment.
Figure 4:
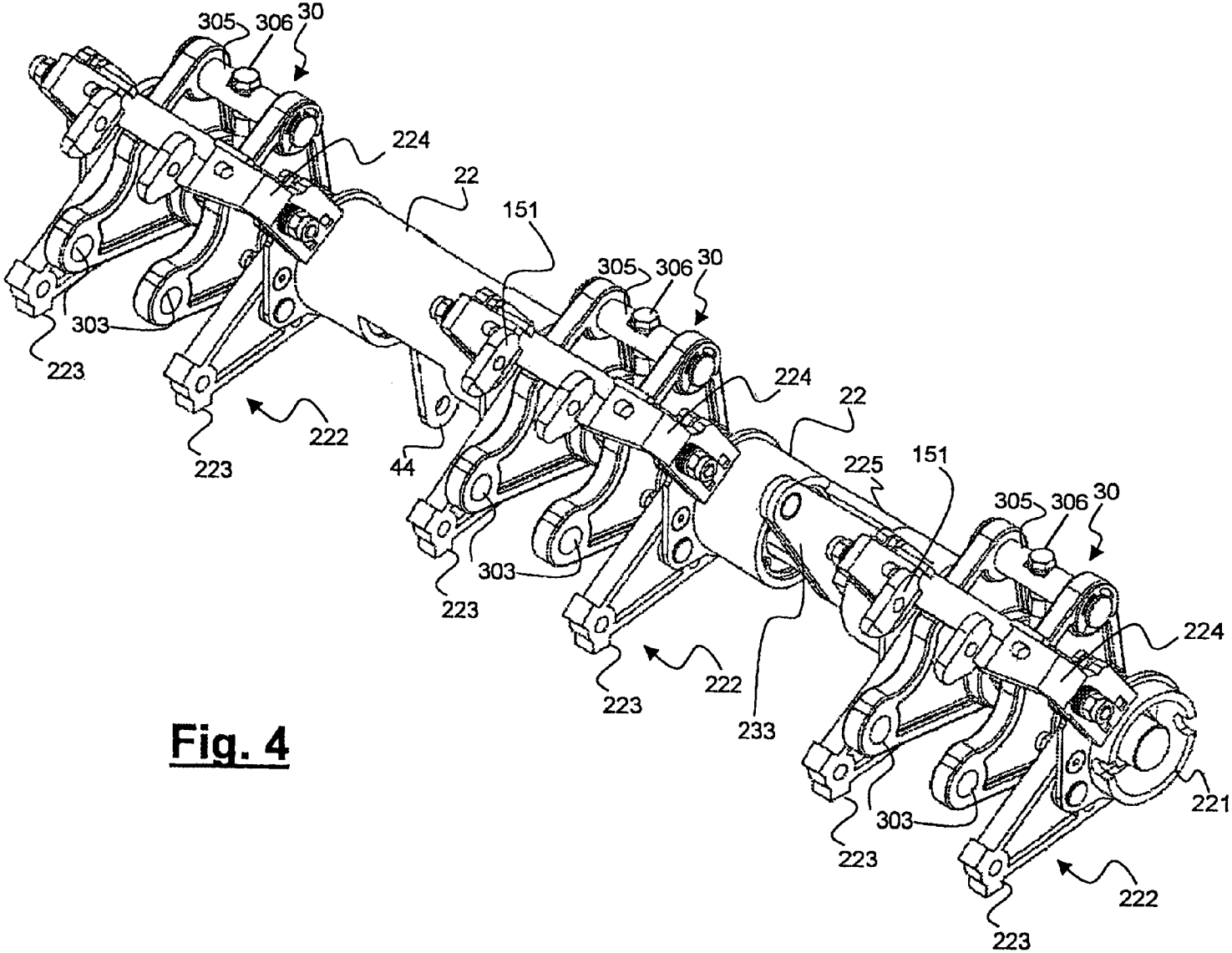
FIG. 4 is an axonometric view of some of the mechanisms of the device according to an example embodiment.

Particular reference will now be made to FIGS. 3 and 4. A first and second shaft 20, 21, both rotatable, are contained inside the casing 11. At least one end 201 of the first shaft 20 projects from the casing 11 (or in any case is accessible from the outside) so that the first shaft 20 may operated, i.e. rotated, using any means, typically by means of a spring-type operating device or an electromagnetic operating system. The first and the second shaft 20, 21 are preferably parallel. The first and the second shaft 20, 21 are connected, for example by means of a lever system 23 (FIG. 3). The lever system 23 and the first shaft form a "connection mechanism". The lever system 23 has the function of gearing down the angle of rotation between the first and the second shaft and therefore increasing the torque transmitted to a value sufficient for being able to move the main contacts 132 of the circuit-breaker described below. In other words, in response to a certain rotation of the first shaft 20 (for example a rotation through 30°), the second shaft 21 is rotated through a proportionally smaller angle (for example 15°). This arrangement allows rotation of the first shaft 20, with application of a torque which is smaller than that which should be applied directly to the second shalt 21.

The lever system 23 comprises a first connecting rod 231 connected (for example keyed) to the first shaft 20, a tie-rod 232 of adjustable length and a second connecting rod 233 connected (for example keyed) to the second shaft 21. The adjustable tie-rod 232 is pivotably hinged on the first and second connecting rod.

The second shaft 21, for reasons which will become clear below, has a cross-section which is polygonal, preferably in the form of a regular hexagon, over at least part of its length, except for the ends. The first shaft 20 also typically has a cross-section which is polygonal, preferably in the form of a regular hexagon.

Preferably, the lever system 23 is situated in the vicinity of the inner end 202 (that which is substantially inaccessible from outside the casing 11) of the first shaft 20, and at about one third of the length of the second shaft 21. In any case, the transfer of the force onto the second shaft 21 occurs in at least an intermediate position thereof. The fact of transferring the force for causing rotation of the second shaft 21 in an intermediate position eliminates, or at least reduces considerably, twist of the second shaft 21 and the entire casing 11.

Figure 5A:
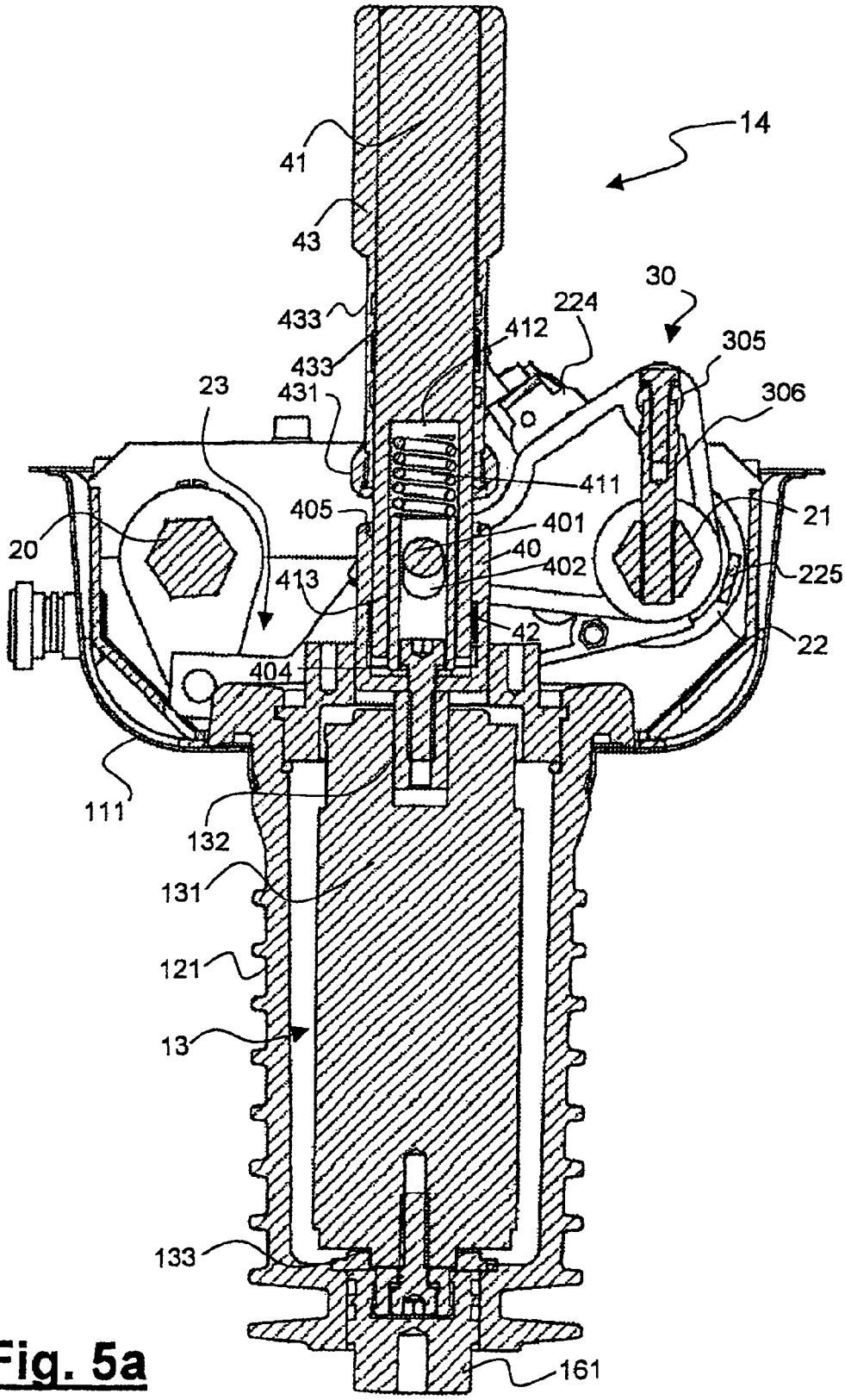
FIGS. 5*a*, 5*b* are internal cross-sections through the device substantially as shown in FIG. 3, for illustrating operation of the circuit-breaker.

The second shalt 21 comprises levers 30 made of insulating material for moving the movable contacts 132 of the bulbs 131. Preferably, two levers 30 made of insulating material are keyed to the second shaft 21, at each bulb 131. In particular, a hollow cup member 40 (see FIG. 5*a*) made of conductive material (for example copper, aluminium, alloys thereof, etc.) is fixed onto the movable contact 132 of each bulb by means of a screw 403 and a washer 404. A round conductor rod 41, slidable vertically inside the respective cup member 40, is arranged inside each cup member 40 of conductive material. A good electrical contact between each round conductor rod 41 and the respective cup member 40 is ensured by means of a sliding contact 42. Centering of each cup member 40 and the respective round conductor rod 41 is ensured by centering guides 405.

A hollow conductor tube 43 with a preferably circular cross-section is fitted onto each round conductor rod 41. The conductor tube has one end (the top end in FIG. 3) which is enlarged. An insulating ring 431 for engagement with a tie-rod 432 (described below) is fixed in the vicinity of one end of the conductor tube 43, i.e. the end close to the cup member 40. In the vicinity of this insulating ring, the conductor tube 43 may be engaged by earthing plates 151 (described below). The conductor tube is provided internally with centering guides 434 (for example made of Teflon or equivalent material) and sliding contacts 433 which ensure a good electric contact between this conductor tube 43 and the round conductor rod 41.

Each round conductor rod 41 has, fixed thereon, a pin 401 which passes through the respective cup member 40 into eyelets 402 extending essentially parallel to the axis of the round conductor rods 41 (and cup members 40). Each pin 401 has, fixed thereto, the two insulating levers 30 keyed to the second shaft 21. A compression spring 411 is arranged inside each cup member 40, inside a cavity 435 of the respective round conductor rod 41. The spring 411 rests against the bottom of the cavity 412 and against a spacing cylinder 413, in turn in contact with the washer 404. As will be clarified below, the function of each spring 411 is that of transferring a correct pressing action to the movable contacts 132 of the bulbs 131. Obviously, the spring 411 could be replaced by an equivalent resilient means.

By way of example a spring suitable for use in connection with the present technology provides a thrust of about 1500 N, with a compression of about 4 mm and a pre-tensioning force of about 1000 N.

The three-phase device 10 according to the embodiment comprises a third shaft 22 for actuating the line isolator 14 and the earthing isolator 15. According to the present invention, advantageously, the third shaft 22 and the second shaft 21 are coaxial. The third shaft 22 is substantially hollow. The second shalt 21 is concentric with the third shaft 22, i.e. the second shaft 21 is contained inside the third shaft 22 and extends substantially over its whole length. The characteristic feature whereby the two shafts 21, 22 are coaxial is particularly advantageous for reducing the dimensions of the device 10, but it will be understood that other alternatives are possible, for example it is possible to envisage a third shaft 22 which is not coaxial with the third shaft 21 and spaced from the latter. One end 221 of the third shaft 22 is accessible from the outside so that it may be moved manually or electrically from the outside.

The third shaft in fact comprises two separate cylindrical sections joined together by metal bars 225 and by bridge brackets 224 which allow the pairs of insulating levers 30 to be arranged underneath them.

Figure 5B:
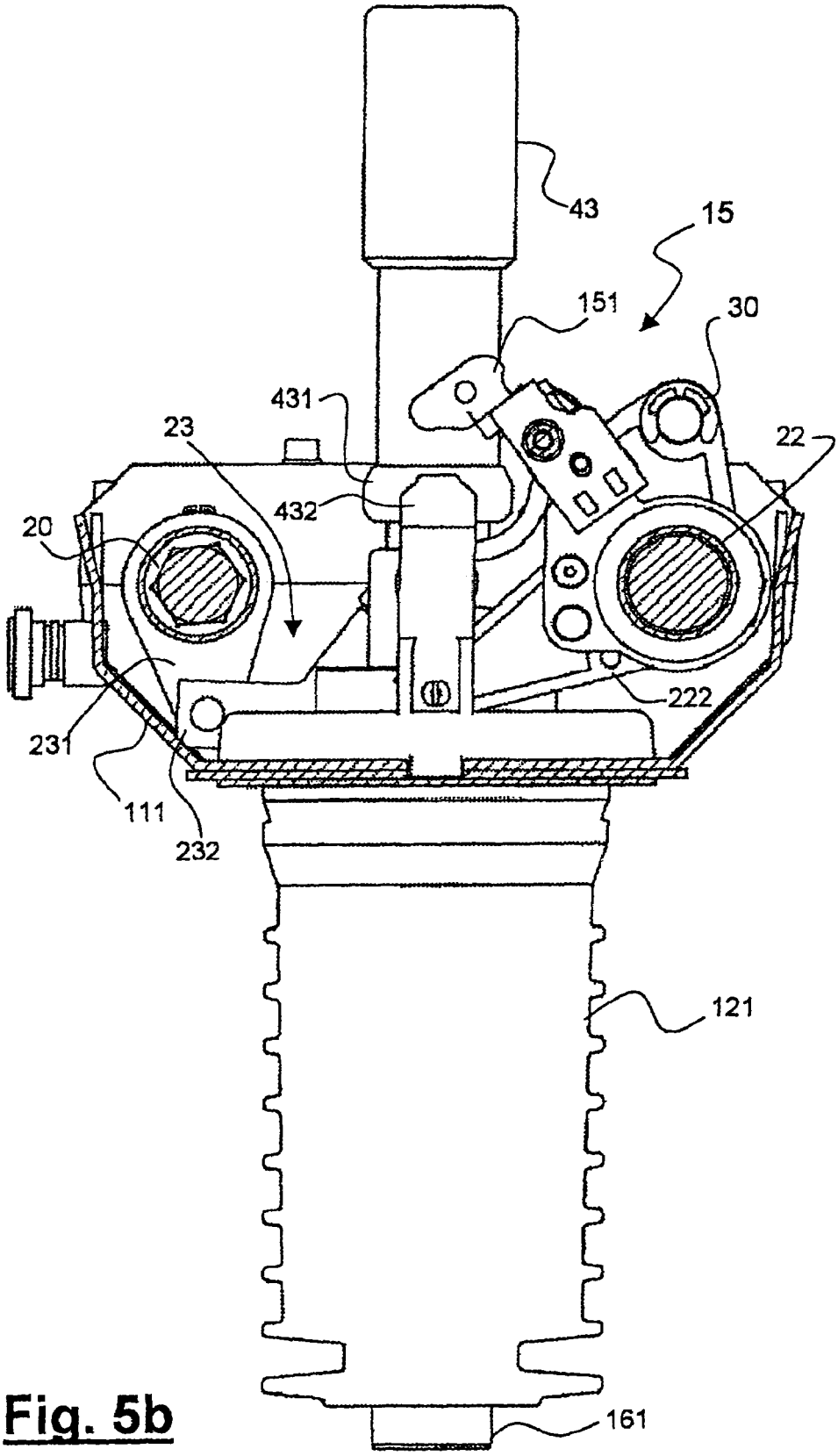

Three pairs of connecting rods 222 (see FIG. 4 and FIG. 5*b*), one pair for each phase, i.e. for each isolator, are connected to the third shaft 22. A tie-rod 432 which engages with the insulating ring 431 of each conductor tube 43 is also connected in the vicinity of the free end 223 of each connecting rod 222. The rotation of the third shalt 22 causes, by means of the connecting rods 222 and the tie-rods 432, displacement of the conductor tube 43. Earthing plates 151 which perform earthing isolation are integrally connected to the third shaft 22, angularly offset with respect to the connecting rods 222. In other words, the earthing plates are fixed to the bridge brackets.

Figure 8:
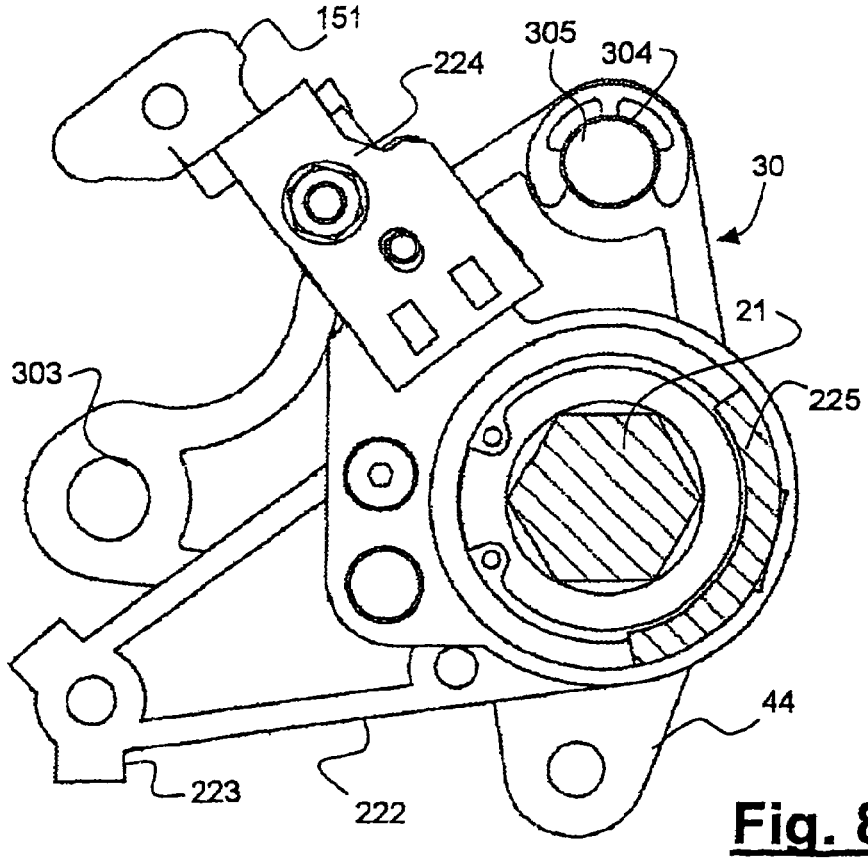
FIG. 8 is a detailed cross-section through the insulating lever according to FIG. 5*b*.

Preferably, a damping device (not shown) constrained to the casing and to a bracket 44 (FIG. 8) is envisaged.

Conveniently, owing to the structure described above, the device 10 according to the invention has dimensions which are much smaller than those of the majority of known devices and is able to maintain the same dimensions as the device according to the patent EP 1,226,596, i.e. a depth of about 900 mm and an overall width of between about 350 and 750 mm, preferably of about 375 mm. Each circuit-breaker 13 is axially in series with the respective line isolator 14 and the insulating bodies 121, 122 inside which they are housed.

Figure 6A:
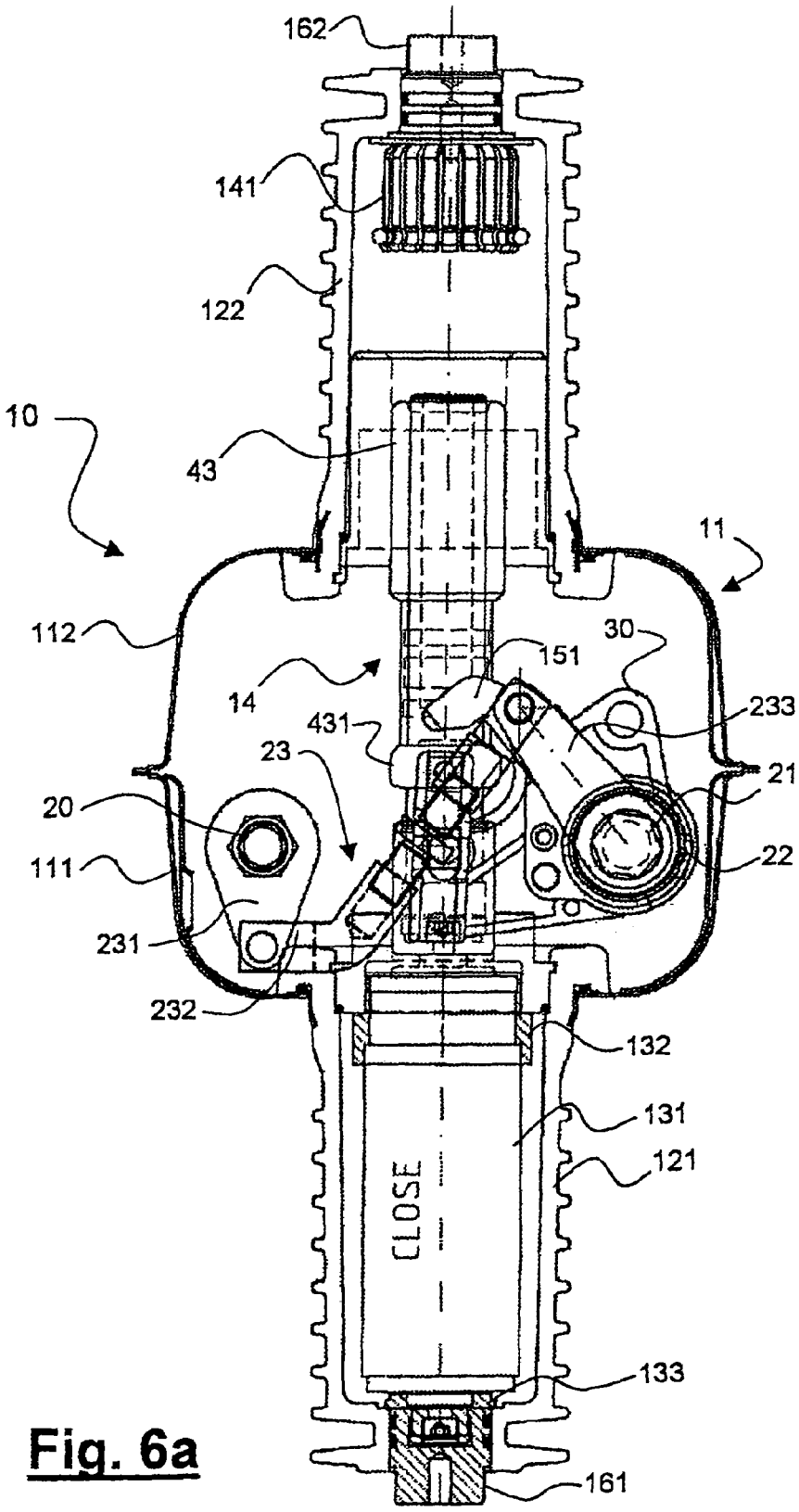
FIGS. 6*a*–6*c* are cross-sections through the device for illustrating operation of the isolator and illustrating the segregation baffles.
Figure 6B:
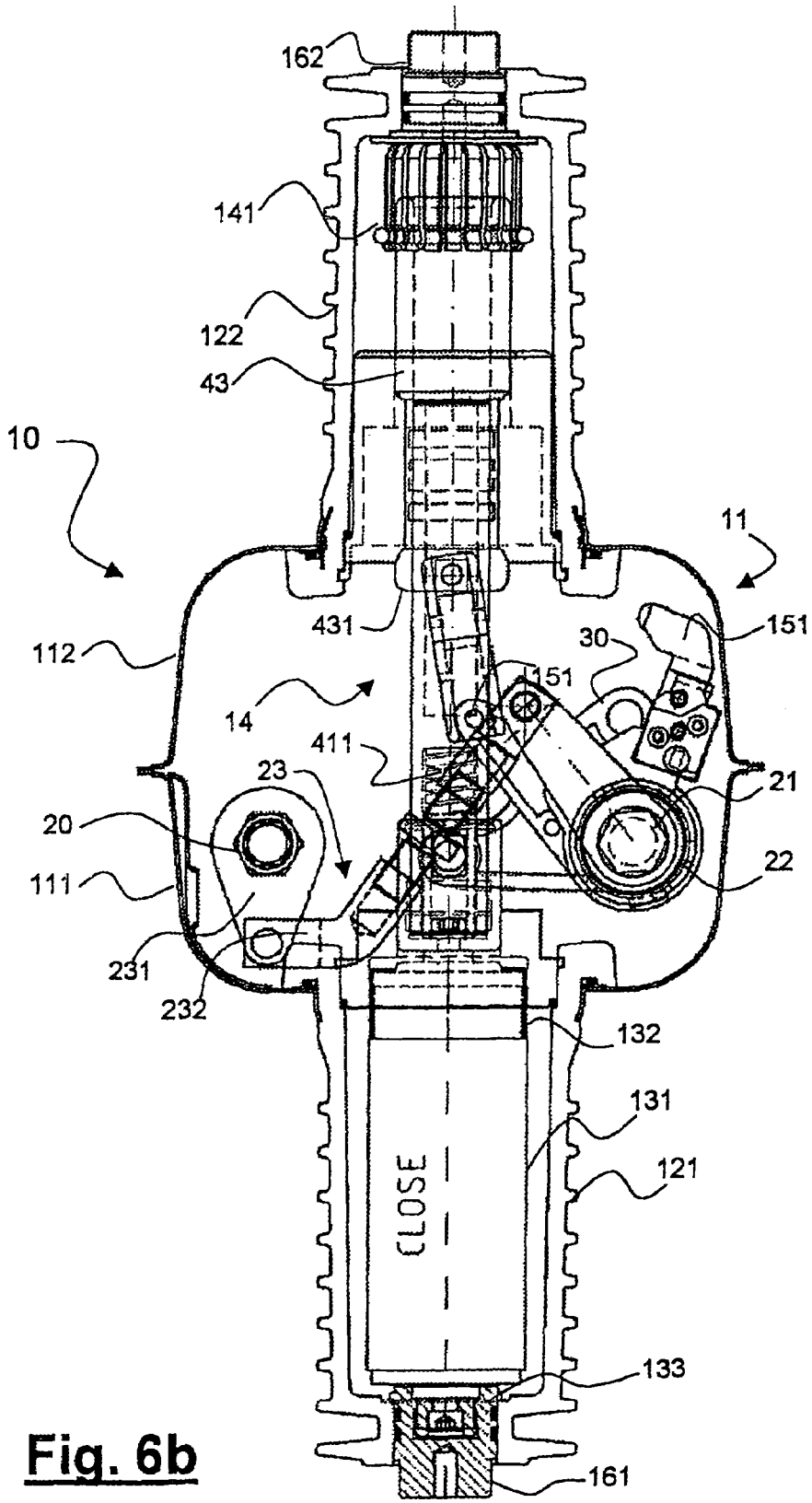
Figure 6C:
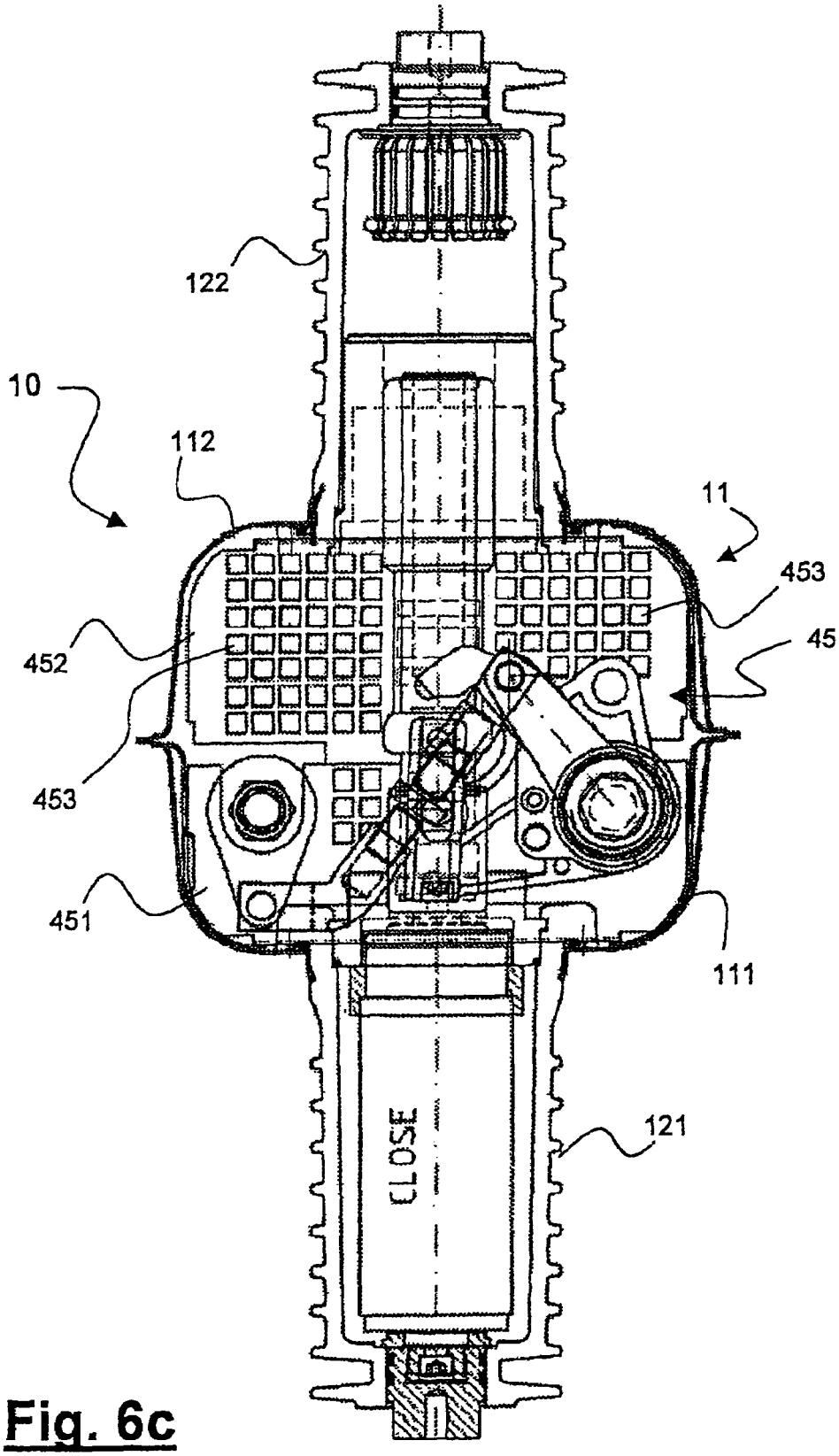

FIGS. 2 and 6*c* show segregation baffles 45 able to intercept any discharges between two phases. Each segregation baffle 44 comprises a bottom half-baffle 451 fixed to the bottom shell 111 of the casing 11 and a top half-baffle 452 fixed to the top shell 112. The half-baffles are fixed, for example, by means of screws. Each baffle 45 comprises holes 453 for allowing the gas contained inside the casing to pass through. In the embodiment shown, the holes 453 have a form which is substantially square with one side equal to about 2.0 to 10.0 mm, preferably 4.0 mm to 5.0 mm. The holes are formed by means of laser cutting, shearing, punching or a similar processing operation. Each segregation baffle 45 is made of a material which is at least partially metallic, preferably steel and has a thickness of about 1.0 mm to 3.0 mm, preferably about 2.0 mm.

The operating principle of the device 10 with reference initially to closing of the circuit-breakers 13 is described hereinbelow.

A command to close the vacuum circuit-breakers 13 is imparted to the device 10, rotating the first shaft 20 through a given angle. The rotation of the first shaft 20 causes a proportional (downward) rotation of the second shaft 21 owing to the lever system 23. The second shaft 21, by means of the levers 30 of insulating material and the pin 401, causes vertical displacement of the round conductor rods 41 (one for each circuit-breaker bulb 131). In turn, each round conductor rod 41, by means of the respective spring 411, moves the cup member 40 inside which it slides and then moves the movable contacts 132 of the bulbs 131 of the circuit-breaker 13. In fact, by displacing around conductor rod 41 downwards, the spring 411 will be compressed, pressing the spacer 413 towards the washer 404 and the bottom of the cup member 40.

When the movable contacts 132 inside the bulbs 131 have performed their travel stroke and are in contact with the fixed contacts 133, they may not move further, being at the end of their travel path. Consequently, the cup members 40 are also unable to move. However, each round conductor rod 41 moves further driven by the pin 401 which at this point slides inside the eyelet 402 until the spring 411 is compressed so as to obtain a correct load between the contacts 132, 133 of the bulb.

The compression loads on the movable contacts 132 of the circuit-breaker 13 are very high (typically in the region of 1000–1500 N). As mentioned above, these loads are transferred from the springs to the second shaft 21 by means of the levers 30 of insulating material. In view of the high compression loads and the relatively short arm, the connection between the insulating levers 30 and the second shaft 21 is extremely critical. In fact, the levers 30, are made of a material with low mechanical strength, typically polycarbonate, nylon polyester, BMC, SMC, polyamides or the like. The risk is that, after a series of manoeuvring cycles, more or less greater play may arise. This play would be totally undesirable since it would not allow the contacts 132, 133 of the circuit-breakers 13 to close or open in a correct, predictable and reliable manner.

The Applicant has faced the problem of wear affecting the levers 30 and the relative inefficiency and lack of reliability which may result from this wear and has verified that this problem may be solved by providing a hole 307 (see FIG. 7) with a polygonal cross-section in the levers 30 and a corresponding polygonal cross-section for the second shaft 21 on which the levers are keyed. Preferably, to hole 307 has a hexagonal cross-section. Preferably, to side of the hexagonal hole 307 has a dimension of about 20 mm–30 mm, typically 24–25 mm.

Moreover, stresses concentrated on the insulating material are avoided in order to prevent structural defomations of the levers or permanent deformations thereof occurring. According to a preferred embodiment (see in particular FIGS. 7 and 8), each lever 30 comprises a first arm 301 and a second arm 302. A hole 303 for fixing the pin 401 is provided in the vicinity of the free end of the first arm 301. Another hole 304 is provided in the vicinity of the free end of the second arm 302, said hole allowing the insertion of a pin 305 connecting together the two levers 30 associated with to same circuit-breaker bulb 131. The connecting pin 305 is preferably made of metallic material. The present embodiment envisages rigidly connecting the pin 305 to to second shaft 21. In the embodiment shown, the rigid connection is peifonned by means of a tie-rod 306 in the form of a (preferably metallic) threaded element which passes transversely through the pin 305 and screws into a hole in the second shaft 21 (see FIG. 5*a*).

Figure 7:
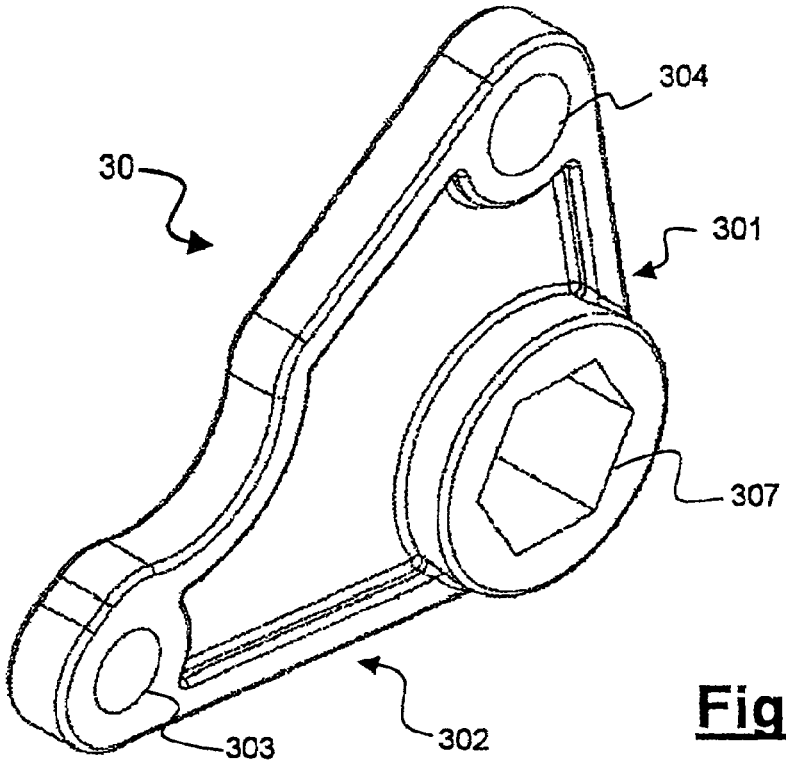
FIG. 7 is an axonometric view of an insulating lever according to an example embodiment.

As shown in FIG. 7, each lever 30 has a roughly triangular shape. According to a preferred embodiment, it has a thickness of about 4 mm in the central part and about 10 mm along the edge. The part around the hole 307 is further thickened to about 20 mm. The distance between the centre of the hole 307 and the hole 303 in the first lever is between about 65 mm and 80 mm, preferably about 72 mm. The distance between the centre of the substantially hexagonal hole 307 and a hole 304 for the connecting pin 305 is between 40 mm and 60 mm, preferably about 50 mm.

Figure 9A:
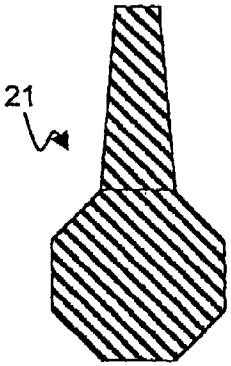
FIGS. 9*a*–9*c* are cross-sections through respective alternative embodiments of a shaft for actuating circuit-breakers according to an example embodiment.
Figure 9B:
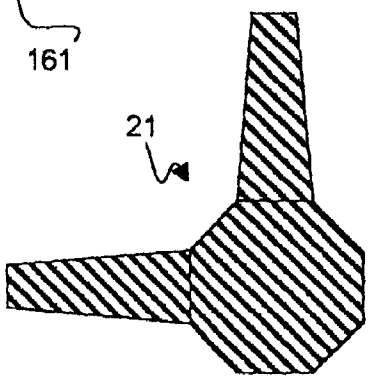
Figure 9C:
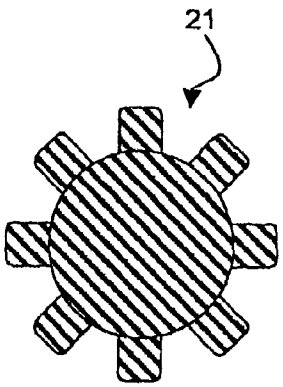

The connection system described and shown here by way of example results in an improved distribution of the connecting forces on the lever 30 so as to limit the abovementioned undesirable wear or structural deformations. The specific force acting on the insulating material is reduced. Obviously, other systems could be used, for example the shaft 21 could be shaped as shown in FIG. 9*a* or 9*b*, where the tie-rod and shaft are formed as one body. As a further alternative, the shaft 21 could be a shaft which is splined and cross-shaped or with a plurality of projecting parts as shown in FIG. 9*c*.

Having described the operation involving closing of the circuit-breakers 13, operation of the isolators 14, 15 will now be described. As mentioned above, the third shaft 22 is concentric with the second shaft 21 and its purpose is that of moving simultaneously the line isolator 14 and the earthing isolator 15. Rotating the third shaft, for example in the clockwise direction (see FIGS. 6*a* and 6*b*), by means of the connecting rods 222 and the respective tie-rods 432 which are engaged with the conductor tubes 43, causes the displacement of the conductor tubes 43 towards the respective top end-pieces 162.

In the position shown in FIG. 6*b*, the conductor tube 43 is inserted in the fixed contact 141. The conductor tube 41 is moreover in contact with the round conductor rod 41, inside it, preferably by means of the sliding contact 42. In the configuration shown in FIG. 6*b* there is therefore electrical continuity between the top end-piece 162 and the bottom end-piece 161 if the contacts 131 inside the circuit-breaker bulb 131 are closed. In this position, the earthing plates 151 (which rotate rigidly with the third shaft 22) do not engage with the respective conductor tube 43.

If, from the position described above, the third shaft 22 is rotated in an anti-clockwise direction, the conductor tubes 43 are drawn downwards and, simultaneously, the earthing plates 151 which are directly fixed to the third shaft 22, move towards the tubes 43 and engage with them.

FIG. 6*a* shows the conductor tube 43 completely isolated from the fixed contact. At the same time, the earthing plates 151 are connected to the conductor tube 43, thereby firmly earthing the tube. In this configuration, by closing the contacts inside the bulb 131 of the circuit-breaker, earthing of the electric circuit situated downstream of the circuit-breaker 13 (user) is ensured.

What is claimed is:

1. An electric device comprising:

a casing;

at least one circuit-breaker;

at least one line isolator having a fixed isolator contact;

a line isolator actuating shaft for actuating the at least one line isolator;

at least one earthing isolator, a circuit-breaker actuating shaft for actuating at least one circuit-breaker;

a lever connected to a conductor rod co-operating with movable circuit-breaker contacts, said conductor rod further engaging with said fixed isolator contact in a closing position, a resilient member co-operating with said conductor rod in order to transfer correct pressing loads to said movable contacts, wherein said circuit-breaker actuating shaft and said line isolator actuating shaft are coaxial and can be rotated independently one from the other; and wherein said circuit-breaker actuating shaft is rotated by rotating a separate shaft which is connected to said circuit-breaker actuating shaft.

2. The electric device according to claim 1, wherein said resilient member is in the form of a compression spring.

3. The electric device according to claim 1, wherein said resilient member is housed inside a cavity in said conductor rod.

4. The electric device according to claim 1, wherein, for each circuit-breaker, a cup member connected to said movable circuit-breaker contacts is provided.

5. The electric device according to claim 4, wherein said lever is connected to the conductor rod by means of a pin and said cup member comprises a longitudinally extending eyelet.

6. The electric device according to claim 1, wherein said resilient member co-operates with a spacer.

7. The electric device according to claim 4, further comprising sliding contacts between the cup member and the conductor rod.

8. The electric device according to claim 4, further comprising centering guides between the cup member and the conductor rod.

9. The electric device according to claim 1, further comprising a mechanism for applying a rotational torque onto said circuit-breaker actuating shaft in at least one intermediate position along its length, said mechanism comprising a first shaft accessible from the outside of said casing and a lever mechanism connecting said first shaft to said circuit-breaker actuating shaft.

10. Electric device according to claim 1, further comprising earthing plates which perform earthing isolation, said earthing plates being connected to said line isolator actuating shaft and cooperating with said conductor rod.

11. The electric device according to claim 1, wherein, for each circuit-breaker, a pair of levers comprised of electrically insulating material are provided, said levers being keyed to said circuit-breaker actuating shaft.

12. The electric device according to claim 11, wherein said insulating material is a material chosen from the group consisting of: polycarbonate, nylon, polyester, BMC, SMO, polyamides or the like.

13. The electric device according to claim 1, wherein said circuit-breaker actuating shaft has a cross-section which is polygonal.

14. The electric device according to claim 1, further comprising two or more phases and at least two circuit-breakers, at least two corresponding line isolators and at least two corresponding earthing isolators, in which a segregation baffle is provided between each line isolator and the corresponding earthing isolator in order to segregate one phase of the device from the adjacent phase.

15. The electric device according to claim 14, wherein the device is a three-phase device.

16. The electric device according to claim 1, wherein each circuit-breaker is axially aligned with a respective line isolator.

17. The electric device according to claim 1, wherein each circuit-breaker comprises a bulb housed inside a respective insulating body projecting from the casing.

18. The electric device according to claim 1, wherein said casing is at least partially filled with a gas which is substantially inert in use.

19. The electric device according to claim 18, wherein said gas is selected from the group comprising: nitrogen, sulphur hexafluoride and any mixture thereof.

20. A cubicle for a switchboard comprising at least one electric device according to claim 1.

21. A switchboard comprising one or more cubicles according to claim 20.

22. An electric device comprising:

a casing;

at least one circuit-breaker having movable circuit-breaker contacts;

at least one line isolator having a fixed isolator contact;

a line isolator actuating shaft for actuating the at least one line isolator;

at least one earthing isolator;

a circuit-breaker actuating shaft for actuating at least one circuit-breaker;

a lever connected to a conductor rod co-operating with movable circuit-breaker contacts;

earthing plates which perform earthing isolation, said earthing plates being connected to said line isolator actuating shaft and cooperating with said conductor rod;

wherein, each circuit-breaker is associated with a pair of said levers and wherein said levers are made of an electrically insulating material.

23. The eleciric device according to claim 22, wherein said insulating material is a material chosen from the group consisting of: polycarbonate, nylon, polyester, BMC, SMC, polyamides or the like.

24. The electric device according to claim 22, wherein at least one of said insulating material levers comprises a hole having a cross-section which is polygonal and wherein said circuit-breaker actuating shaft has a corresponding polygonal cross-section.

25. The electric device according to claim 1, wherein the electric device has two or more phases and comprises:

at least two line isolators;

at least two earthing isolators;

wherein a segregation baffle is provided between a line isolator and a corresponding earthing isolator of a first phase and a line isolator and a corresponding earthing isolator of an adjacent second phase in order to segregate said first phase of the device from the adjacent second phase.

26. The electric device according to claim 25, wherein said segregation baffle comprises holes for allowing gas contained inside the casing to pass through.

27. The electric device according to claim 25, wherein said casing is at least partially filled with a gas which is substantially inert in use.

28. The electric device according to claim 27, wherein said gas is selected from the group comprising: nitrogen, sulphur hexafluoride and any mixture thereof.

29. The electric device according to claim 1, wherein the electric device has two or more phases and comprises:

at least two line isolators;

at least two earthing isolators;

wherein a segregation baffle is provided between a line isolator and a corresponding earthing isolator of a first phase and a line isolator and a corresponding earthing isolator of an adjacent second phase in order to segregate said first phase of the device from the adjacent second phase.

30. The electric device according to claim 29, wherein said segregation baffle comprises holes for allowing gas contained inside the casing to pass through.

31. The electric device according to claim 29, wherein said casing is at least partially filled with a gas which is substantially inert in use.

32. The electric device according to claim 31, wherein said gas is selected from the group comprising: nitrogen, sulphur hexafluoride and any mixture thereof.

* * * * *